US009032756B2

(12) United States Patent
Kim et al.

(10) Patent No.: US 9,032,756 B2
(45) Date of Patent: May 19, 2015

(54) AIR CONDITIONER

(75) Inventors: Beomchan Kim, Seoul (KR); Byoungjin Ryu, Seoul (KR); Yonghee Jang, Seoul (KR); Younghwan Ko, Seoul (KR); Byeongsu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 316 days.

(21) Appl. No.: 13/607,065

(22) Filed: Sep. 7, 2012

(65) Prior Publication Data

US 2013/0055749 A1 Mar. 7, 2013

(30) Foreign Application Priority Data

Sep. 7, 2011 (KR) ..... 10-2011-0090778

(51) Int. Cl.

| | |
|---|---|
| ***F25B 41/00*** | (2006.01) |
| ***F25B 40/02*** | (2006.01) |
| ***F28F 9/02*** | (2006.01) |
| ***F28D 7/06*** | (2006.01) |
| ***F28D 7/16*** | (2006.01) |
| *F25B 13/00* | (2006.01) |

(52) U.S. Cl.

CPC ..... *F25B 40/02* (2013.01); *F25B 13/00* (2013.01); *F25B 2400/13* (2013.01); *F28F 9/0246* (2013.01); *F28D 7/06* (2013.01); *F28D 7/1607* (2013.01)

(58) Field of Classification Search

CPC .... F25B 40/02; F25B 2400/13; F28D 7/1607; F28D 7/005; F28D 7/0058

USPC ..... 62/513

See application file for complete search history.

(56) References Cited

U.S. PATENT DOCUMENTS

| | | | | |
|---|---|---|---|---|
| 4,072,183 | A * | 2/1978 | Fraas | 165/134.1 |
| 2008/0314570 | A1* | 12/2008 | Singh et al. | 165/158 |
| 2010/0223939 | A1* | 9/2010 | Mitra et al. | 62/117 |

FOREIGN PATENT DOCUMENTS

| | | | |
|---|---|---|---|
| DE | 9412931 | U1 | 9/1994 |
| DE | 4409920 | A1 | 10/1995 |
| DE | 19824881 | A1 | 12/1999 |
| FR | 2776371 | A1 | 9/1999 |
| KR | 1999-011196 | | 3/1999 |
| KR | 2001-0090934 | | 10/2001 |
| KR | 2004-0054282 | | 6/2004 |
| WO | 8200511 | A1 | 2/1982 |
| WO | 2009082367 | A1 | 7/2009 |

* cited by examiner

*Primary Examiner* — Cassey D Bauer

(74) *Attorney, Agent, or Firm* — McKenna Long & Aldridge LLP

(57) ABSTRACT

Provided is an air conditioner. The air conditioner includes a compressor, a condenser, an expansion device, an evaporator, and a supercooling device configured to supercool a refrigerant passing through the condenser. The supercooling device includes a supercooling main body in which the refrigerant passing through the condenser and a refrigerant to be injected into the compressor are introduced, a first passage disposed within the supercooling main body so that the refrigerant passing through the condenser flows in one direction, a second passage disposed on a side of the first passage so that the refrigerant passing through the condenser flows in the other direction, and a third passage in which the refrigerant to be injected into the compressor flows, the third passage being heat-exchanged with at least one of the first and second passages.

18 Claims, 7 Drawing Sheets

AIR CONDITIONER

CROSS-REFERENCE TO RELATED APPLICATIONS

The present application claims priority under 35 U.S.C. 119 and 35 U.S.C. 365 to Korean Patent Application No. 10-2011-0090778 filed on Sep. 7, 2011, which is hereby incorporated by reference in its entirety.

BACKGROUND

The present disclosure relate to an air conditioner.

Air conditioners are home appliances that maintain indoor air into the most proper state according to use and purpose thereof. For example, such an air conditioner controls indoor air into a cold state in summer and controls indoor air into a warm state in winter. Furthermore, the air conditioner controls humidity of the indoor air and purifies the indoor air to become into a pleasant and clean state.

In detail, the air conditioner has a refrigeration cycle in which compression, condensation, expansion, and evaporation processes of a refrigerant are performed. Thus, a cooling or heating operation of the air conditioner may be performed to cool or heat the indoor air according to the refrigeration cycle.

Such an air conditioner may be classified into a split type air conditioner in which indoor and outdoor units are separated from each other and an integral type air conditioner in which indoor and outdoor units are integrally coupled to each other as a single device, according to whether the indoor and outdoor units are separated from each other. The outdoor unit includes an outdoor heat exchanger heat-exchanging with external air, and the indoor unit includes an indoor heat exchanger heat-exchanging with indoor air. The air conditioner may be operated in a cooling mode or heating mode which are converted into each other.

When the air conditioner is operated in the cooling mode, the outdoor heat exchanger serves as a condenser, and the indoor heat exchanger servers as an evaporator. On the other hand, when the air conditioner is operated in the heating mode, the outdoor heat exchanger serves as an evaporator, and the indoor heat exchanger serves as a condenser.

A supercooler for supercooling a refrigerant condensed by the condenser may be further provided in the air conditioner. The supercooler is configured to heat-exchange a main refrigerant circulating into the refrigeration cycle with a branched refrigerant partially branched from the main refrigerant and expanded. Thus, the main refrigerant and the branched refrigerant may be heat-exchanged with each other to supercool the main refrigerant.

In the supercooler according to the related art, a pipe through which the main refrigerant and the branched refrigerant flow may be provided as a spiral tube type. The main refrigerant may be supercooled through the heat exchange due to contact of the tube.

In a case where the pipe of the heat exchanger is provided as the spiral tube type, a heat-exchange area between the main refrigerant and the branched refrigerant may be limited to deteriorate heat-exchange efficiency between the main refrigerant and the branched refrigerant. Thus, there is a limitation that the refrigerant is not sufficiently supercooled.

SUMMARY

Embodiments provide an air conditioner which supercools a refrigerant to improve efficiency of a refrigeration cycle.

In one embodiment, an air conditioner including a compressor, a condenser, an expansion device, an evaporator, and a supercooling device configured to supercool a refrigerant passing through the condenser, wherein the supercooling device includes: a supercooling main body in which the refrigerant passing through the condenser and a refrigerant to be injected into the compressor are introduced; a first passage disposed within the supercooling main body so that the refrigerant passing through the condenser flows in one direction; a second passage disposed on a side of the first passage so that the refrigerant passing through the condenser flows in the other direction; and a third passage in which the refrigerant to be injected into the compressor flows, the third passage being heat-exchanged with at least one of the first and second passages.

In another embodiment, an air conditioner includes: a compressor compressing a refrigerant; a condenser condensing the refrigerant passing through the compressor; and a supercooler disposed on a side of an outlet of the condenser, wherein the supercooler includes: a first inflow part through which the refrigerant passing through the condenser is introduced; a second inflow part through which a refrigerant to be injected into the compressor is introduced; a first passage disposed within the supercooler, the first passage being configured to primarily heat-exchange the refrigerant introduced through the first inflow part with the refrigerant introduced through the second inflow part; a second passage communicating with the first passage, the second passage being configured to secondarily heat-exchange the refrigerant passing through the first passage with the refrigerant introduced through the second inflow part; and a flow space part in which the refrigerant introduced through the second inflow part flows, the flow space part being configured to cool the refrigerants of the first and second passages.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
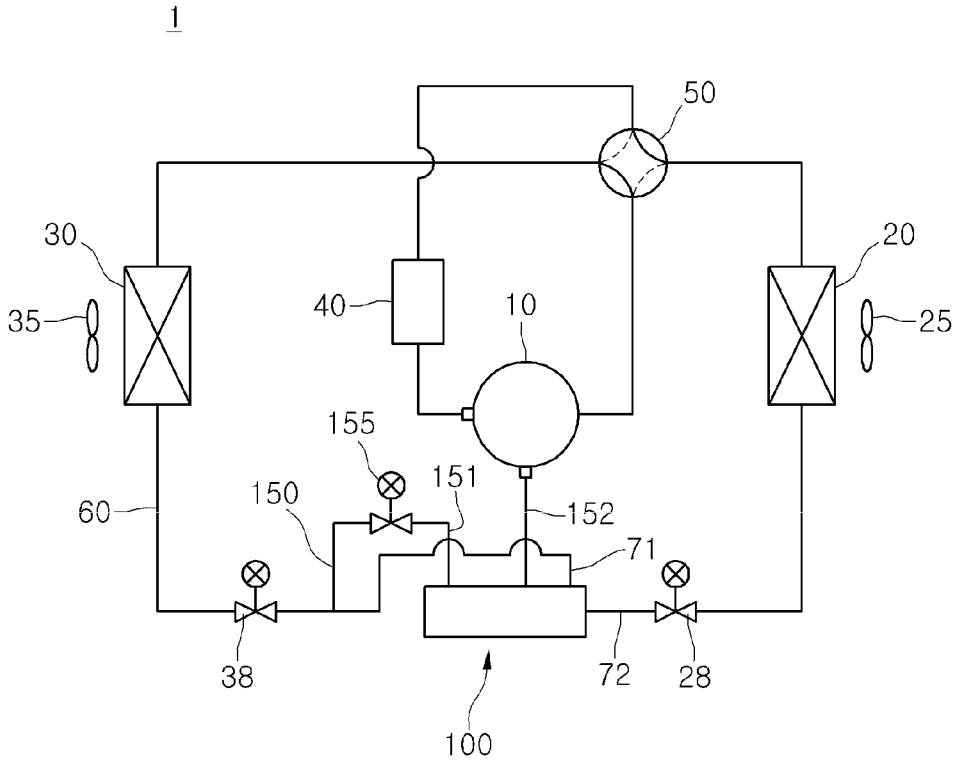
FIG. 1 is a view illustrating a system of an air conditioner according to a first embodiment.

FIG. 1 is a view illustrating a system of an air conditioner according to a first embodiment.

Referring to FIG. 1, an air conditioner 1 according to an embodiment has a refrigeration cycle in which a refrigerant is circulated. The air conditioner 1 may perform a cooling or heating operation according to a circulation direction of the refrigerant.

When the air conditioner 1 performs the heating operation, the air conditioner 1 includes a compressor 10 for compressing the refrigerant, a gas/liquid separator 40 disposed on a side of an inlet of the compressor 10 to separate a liquid refrigerant from the refrigerant introduced into the compressor 10, an indoor heat exchanger 20 for heat-exchanging the refrigerant compressed by the compressor 10 with indoor air, an outdoor expansion device 38 for expanding the refrigerant condensed in the indoor heat exchanger 20, an outdoor heat exchanger 30 for heat-exchanging the expanded refrigerant with external air, a four-way valve 50 for controlling a circulation direction of the refrigerant discharged from the compressor 10, and a refrigerant tube 60 connecting the above-described parts to each other and guiding a flow of the refrigerant.

Blower fans 25 and 35 for blowing a fluid (air) to be heat-exchanged with the refrigerant are provided in the indoor heat exchanger 20 and the outdoor heat exchanger 30, respectively. The blower fans 25 and 35 include an indoor fan 25 and an outdoor fan 35.

When the cooling operation is performed according to the control of the four-way valve 50, the refrigerant may be circulated in a direction opposite to the above-described refrigerant circulation direction in the heating operation. That is, after the refrigerant passes through the compressor 10 and the outdoor heat exchanger 30, the refrigerant is expanded in the indoor expansion device 28 and then heat-exchanged in the indoor heat exchanger 20.

When the air conditioner 1 performs the cooling operation, a supercooling device 100 (supercooler) for supercooling the refrigerant condensed in the outdoor heat exchanger 30 is provided between the outdoor heat exchanger 30 and the indoor heat exchanger 20 with respect to the flow direction of the refrigerant.

The refrigerant tube 60 includes a main inflow part for introducing a main refrigerant into the supercooling device 100 and a main discharge part 72 for guiding the discharge of the main refrigerant passing through the supercooling device 100. The main refrigerant may be called a "first refrigerant" as a refrigerant flowing into the refrigerant tube 60.

The air conditioner 1 includes an injection passage 150 configured to branch at least one portion of the first refrigerant within the refrigerant tube 60 to inject the branched refrigerant into the compressor 10. The injection passage 150 is branched from the refrigerant tube 60 and connected to the supercooling device 100. At least one refrigerant branched from the first refrigerant may be called a "second refrigerant".

The injection passage 150 includes an injection inflow part 151 configured to introduce the branched refrigerant into the supercooling device 100. The injection inflow part 151 may be understood as an inflow part defined in a position different from that of the main inflow part 71.

Also, the injection passage 150 includes an injection discharge part 152 for guiding the refrigerant introduced through the injection inflow part 151 so that the refrigerant is discharged after passing through the supercooling device 100. The injection discharge part 152 may be a discharge part defined in a position different form that of the main discharge part 72. The refrigerant discharged through the injection discharge part 152 is injected into the compressor 10.

As described above, at least one portion of the refrigerant flowing into the refrigerant tube 60 may pass through the supercooling device 100, and then the refrigerant may be introduced into the compressor 10 to increase an amount of refrigerant circulating into the compressor 10 or the refrigerant system.

The injection passage 150 includes an injection expansion device 155 for expanding the second refrigerant. The second refrigerant may be changed into a relatively low-temperature low-pressure state than the first refrigerant while passing through the injection expansion device 155. Thus, the second refrigerant may be heat-exchanged with the first refrigerant in the supercooling device 100 to supercool the first refrigerant. The first refrigerant supercooled in the supercooling device 100 may be expanded while passing through the indoor expansion device 28 and be evaporated in the indoor heat exchanger 20.

Although the refrigerant flow in the supercooling device during the cooling operation of the air conditioner is described above, when the four-way valve 50 is adjusted to perform the heating operation, the refrigerant may flow in a direction opposite to the refrigerant flow direction in the cooling operation.

In detail, the refrigerant condensed in the indoor heat exchanger 20 is introduced into the supercooling device 100 through the main discharge part 72 and then is discharged into the main inflow part 71. Also, the discharged first refrigerant is expanded in the outdoor expansion device 38 and then evaporated in the outdoor heat exchanger 30.

A portion of the first refrigerant discharged from the main inflow part 71, i.e., the second refrigerant is branched into the injection passage 150, expanded in the injection expansion device 155, and introduced into the supercooling device 100. The first and second refrigerants are heat-exchanged with each other within the supercooling device 100. Here, the first refrigerant is supercooled, and the second refrigerant is evaporated and injected into the compressor 10.

Hereinafter, the supercooling device 100 will be described with reference to the accompanying drawings.

Figure 2:
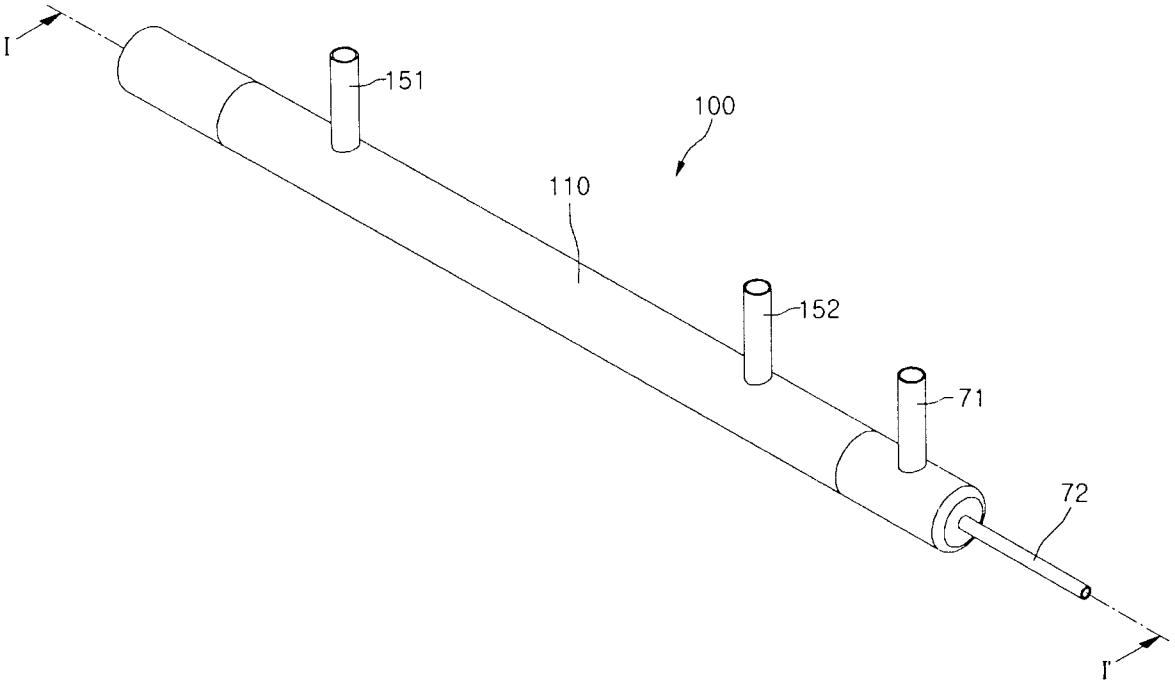
FIG. 2 is a perspective view of an outer appearance of a supercooler according to the first embodiment.
Figure 3:
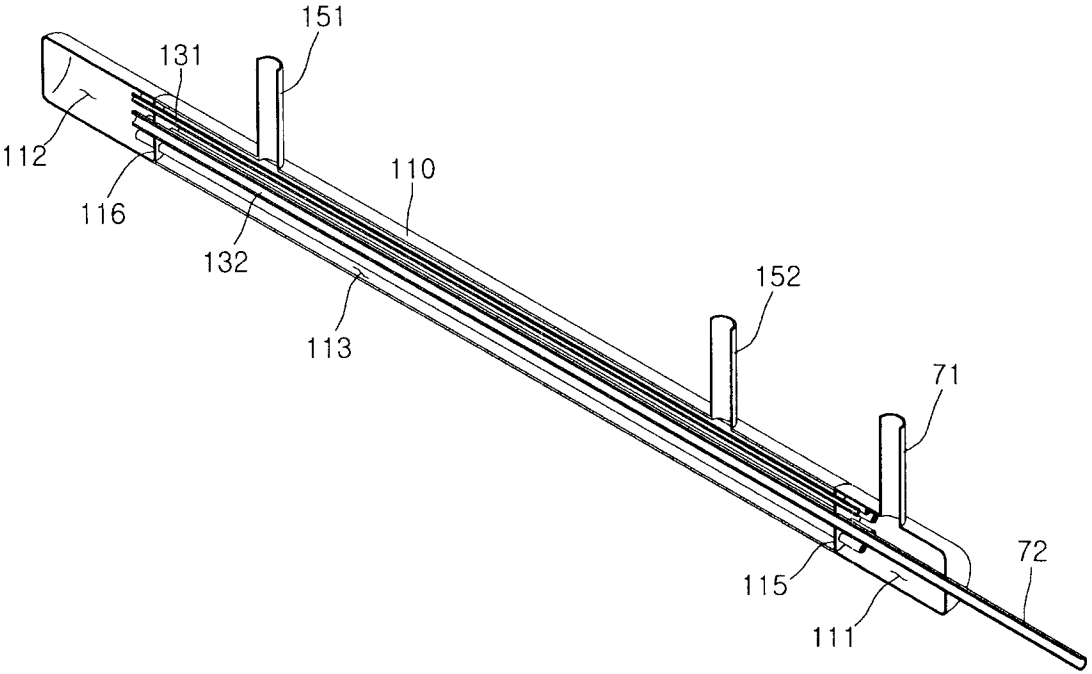
FIG. 3 is a cross-sectional view taken along line I-I' of FIG. 2.
Figure 4:
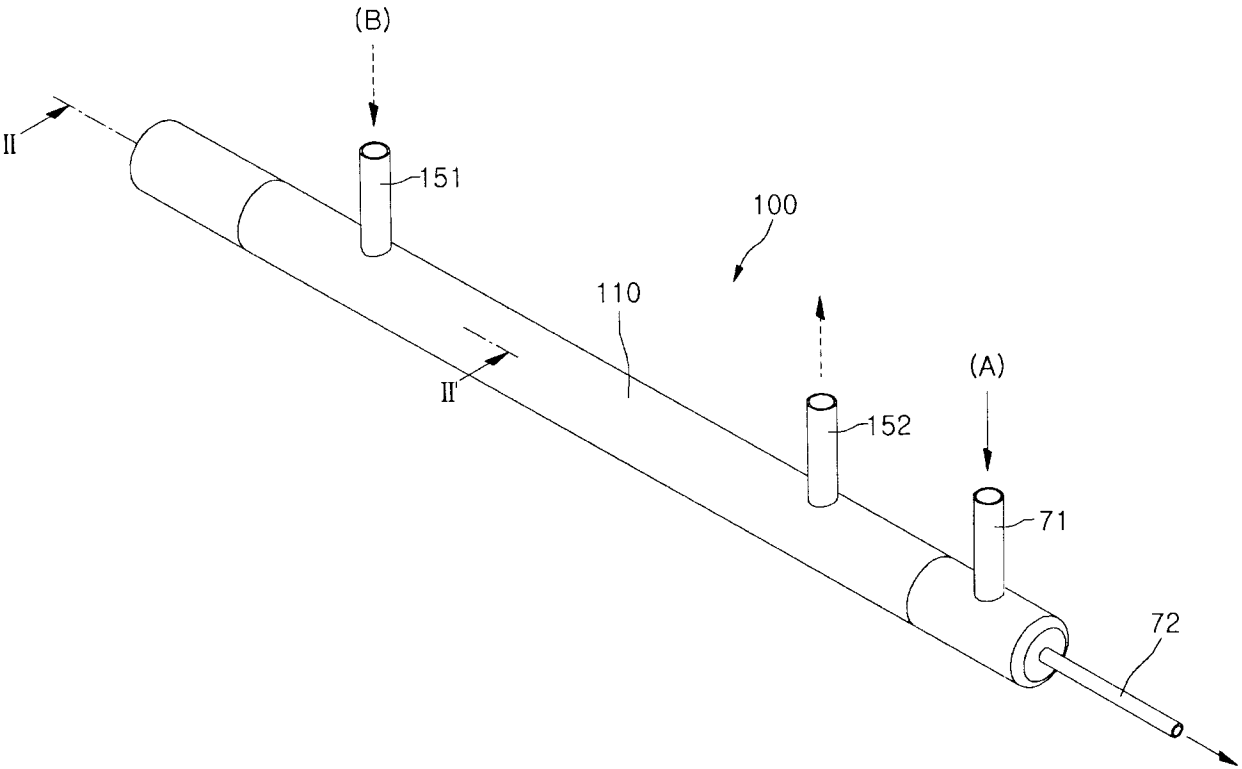
FIG. 4 is a view illustrating a refrigerant flow according to the first embodiment.
Figure 5:
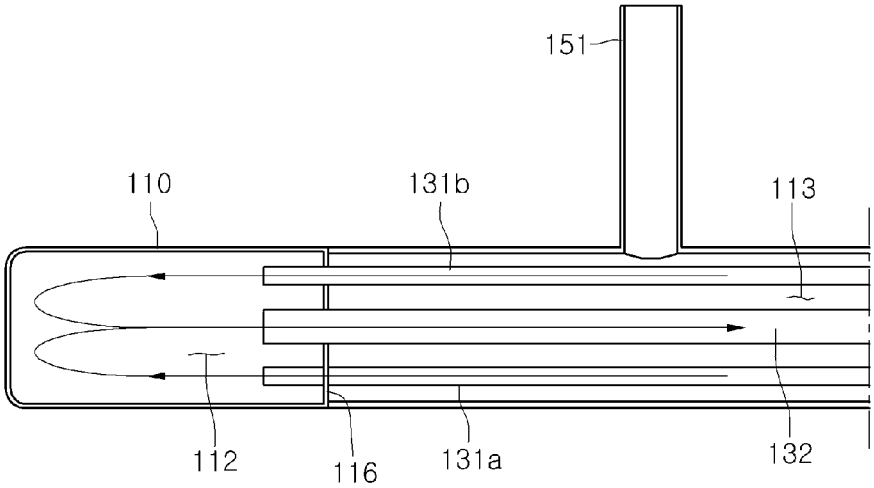
FIG. 5 is a cross-sectional view taken along line II-II' of FIG. 4.

FIG. 2 is a perspective view of an outer appearance of a supercooler according to the first embodiment. FIG. 3 is a cross-sectional view taken along line I-I' of FIG. 2. FIG. 4 is a view illustrating a refrigerant flow according to the first embodiment. FIG. 5 is a cross-sectional view taken along line II-II' of FIG. 4.

Referring to FIGS. 2 to 5, the supercooling device 100 according to the current embodiment includes a supercooling main body 110 providing a flow space in which the first and second refrigerants flow. The supercooling main body 110 may be a hollow tube having an empty space therein.

The supercooling device 100 includes the main inflow part 71 disposed on one side of the supercooling main body 110 to guide the inflow of the first refrigerant when the cooling operation is performed and the main discharge part 72 disposed on the other side of the supercooling main body 110 to guide the discharge of the first refrigerant.

Also, the supercooling device 100 includes the injection inflow part 151 disposed on one side of an outer circumference surface of the supercooling main body 110 to guide the inflow of the second refrigerant and the injection discharge part 152 disposed on the other side of the outer circumference surface of the supercooling main body 110 to guide the discharge of the second refrigerant.

The main inflow part 71, the main discharge part 72, the injection inflow part 151, and the injection discharge part 152 may be disposed on different positions of the outer surface of the supercooling main body 110, and thus be separated from each other. Also, the main inflow part 71 and the injection inflow part 151 may be called a "first inflow part" and a "second inflow part" in that a refrigerant is introduced, respectively. The main discharge part 72 and the injection discharge part 152 may be called a "first discharge part" and a "second discharge part", respectively.

A plurality of refrigerant tubes 131 and 132 in which the first refrigerant flows are provided within the supercooling main body 110.

In detail, the plurality of refrigerant tubes 131 and 132 include a branch tube 131 in which the first refrigerant introduced through the main inflow part 71 is branched and introduced and a combining tube 132 in which the first refrigerants flowing into the branch tubes 131 are mixed to flow. The branch tube 131 and the combining tube 132 in total may be called an "inner tube".

The branch tube 131 may be provided in plurality. Also, each of the branch tubes 131 may have a flow sectional area less than that of the combining tube 132. Also, at least one combining tube 132 may be provided. For example, at least one of the branch tubes 131 and the combining tube 132 may be a capillary tube.

The branch tubes 131 and the combining tube 132 may be disposed spaced from each other. Also, a first branch tube 131*a* of the plurality of branch tubes 131 extends from one side of the combining tube 132 along the supercooling main body 110, and a second branch tube 131*b* extends from the other side of the combining tube 132 along the supercooling main body 110.

The "one side" and "the other side" of the combining tube 132 may be opposite to each other with respect to the combining tube 132. That is, the combining tube 132 may be disposed between the plurality of branch tubes 131. In summary, the branch tubes 131, each having a small flow sectional area, are disposed outside the combining tube 132, and the combining tube 132 is disposed on a center of the supercooling main body 110.

Due to the small flow sectional area, a flow rate of the refrigerant flowing into the branch tubes 131 may be relatively high. The refrigerant flowing into the plurality of branch tubes 131 may be combined within the combining tube 132 disposed between the plurality of branch tubes 131, i.e., adjacent thereto. Thus, a flow rate of the refrigerant may not be reduced. That is, an entire flow rate of the refrigerant within the supercooling main body may be increased to improve a heat transfer coefficient.

A plurality of partition parts 115 and 116 for partitioning an inner space of the supercooling main body 110 into a plurality of spaces are disposed in the supercooling main body 110.

In detail, the plurality of partition parts 115 and 116 includes a first partition part 115 disposed within the supercooling main body 110 between the main inflow part 71 and the injection discharge part 152 and a second partition part 116 disposed within the supercooling main body 110 between the injection inflow part 151 and an end of a side of the supercooling main body 110. Here, the end of the side of the supercooling main body 110 represents a side opposite to an end of a side of the supercooling main body 110 in which the main discharge part 72 is disposed.

The inner space of the supercooling main body 110 may be divided into a branch part 111, a combine part 112, and a flow space part 113 by the first and second partition parts 115 and 116. The branch part 111 and the combine part 112 may be understood as spaces in which the first refrigerant flows, and the flow space part 113 may be understood as a space in which the second refrigerant flows.

The branch part 111 is defined in one side of the flow space part 113, and the combine part 112 is defined in the other side of the flow space part 113. In detail, the branch part 111 may be defined as an inner space of the supercooling main body 110 on which the main inflow part is disposed, and the combine part 112 may be defined in a side opposite to the branch part 111 with respect to the flow space part 113.

The branch part 111 may be a flow space of the first refrigerant introduced through the main inflow part 71 to guide the first refrigerant so that the first refrigerant is branched into the branch tubes 131.

The combine part 112 may be a space in which the first refrigerants flowing into the plurality of branch tubes 131 are mixed before the first refrigerants are introduced into the combining tube 132. The combine part 112 guides the first refrigerants so that the first refrigerants are introduced into the combining tube 132.

Also, the flow space part 113 may be understood as remaining spaces except the branch tube 131 and the combining tube 132 between the first partition part 115 and the second partition part 116, i.e., outer spaces of the branch tube 131 and the combining tube 132. Also, the flow space part 113 may be understood as a passage in which the refrigerant introduced through the injection inflow part 151 flows until the refrigerant is discharged through the injection discharge part 152.

The first partition part 115 is coupled to one side of the branch tube 131, and the second partition part 116 is coupled to the other side of the branch tube 131.

In detail, at least one portion (an end of a side) of the branch tube 131 passes through the first partition part 115 to protrude to the branch part 111, and the other portion (an end of the other side) of the branch tube 131 passes through the second partition part 116 to protrude to the combine part 112.

At least one portion of (an end of a side) of the combining tube 132 passes through the second partition part 116 to protrude to the combine part 112, and an end of the other side of the combining tube 132 is coupled to the main discharge part 72 via the branch part 111. The combining tube 132 may be integrated with the main discharge part 72.

A refrigerant flow and heat exchange effect according to an embodiment will be described below.

The first refrigerant condensed while passing through the condenser is introduced into the branch part 111 through the main inflow part 71(A). Also, the second refrigerant branched into the injection passage 150 is introduced into the flow space part 113 through the injection inflow part 151.

The first refrigerant of the branch part 111 is branched through the plurality of branch tubes 131 to flow in one direction (a left direction in FIGS. 3 and 5) along the inside of the supercooling main body 110.

The first refrigerant flowing into the branch tube 131 is heat-exchanged with the second refrigerant of the flow space part 113. Here, the second refrigerant is introduced through the injection inflow part 151 and widely spread into the flow space part 113. Then, the second refrigerant flows toward the injection discharge part 152.

The first refrigerant of the plurality of branch tubes 131 may flow into the combine part 113 and then mixed with each other. The combined first refrigerant is introduced into the combining tube 132 to flow in the other direction (a right direction in FIGS. 3 and 5) along the inside of the supercooling main body 110. Then, the first refrigerant is discharged to the outside of the supercooling device 100 through the main discharge part 72. The first refrigerant flowing into the combining tube 132 is heat-exchanged with the second refrigerant of the flow space part 113.

A passage of the refrigerant flowing into the branch tube 131 may be called a "first passage", and a passage of the refrigerant flowing into the combining tube 132 may be called a "second passage". As described above, a flow sectional area of the second passage is greater than that of the first passage. Also, the second passage may be defined between a plurality of first passages. A passage of the refrigerant flowing into the flow space part 113 may be called a "third passage".

A refrigerant flow direction in the first passage and a refrigerant flow direction in the second passage may be opposite to each other to improve heat transfer efficiency.

Since the flow space part 113 is separated from the branch part 111 and the combine part 112 by the partition parts 115 and 116, a passage in which the first refrigerant flows is partitioned from a passage in which the second refrigerant flows. Thus, it may prevent the first refrigerant and the second refrigerant from being mixed with each other.

In view of a flow of the first refrigerant, the first refrigerant may be primarily heat-exchanged with the second refrigerant in the branch tube 131, and then secondarily heat-exchanged with the second refrigerant in the combining tube 132. As described above, since the first refrigerant is heat-exchanged two times with the second refrigerant during the flow thereof, the first refrigerant may be sufficiently supercooled.

In view of a flow of the second refrigerant, the second refrigerant is heat-exchanged with the first refrigerant in the branch tube 131 and the combining tube 132 at the same time. As described above, since the second refrigerant is heat-exchanged with the first refrigerant, the refrigerant injected into the compressor 10 may be sufficiently secured.

According to the current embodiment, a tube having a small diameter such as a capillary tube may be included in the first or second passage to increase a flow rate (heat rate) of the first refrigerant. Thus, a heat transfer coefficient may be increased to improve heat transfer efficiency.

Also, the condensed first refrigerant may flow into the branch tube 131 or the combining tube 132, and the second refrigerant having two-phase states may flow outside the branch tube 131 or the combining tube 132 to reduce a flow loss.

That is, when the second refrigerant flows into the branch tube 131, since a liquid refrigerant flows into one branch tube of the plurality of branch tubes 131, and a gas refrigerant flows into the other branch tube, the two-phase refrigerant may not be uniformly distributed. However, the current embodiment may prevent the two-phase refrigerant from being non-uniformly distributed. Also, the flow loss may be reduced to increase the flow rate of the refrigerant and improve the heat-exchange efficiency.

Hereinafter, second and third embodiments will be described. The embodiments are equal to the first embodiment except for the supercooling device. Thus, their different points may be mainly described, and also, the same parts as those of the first embodiment will be denoted by the same description and reference numeral.

Figure 6:
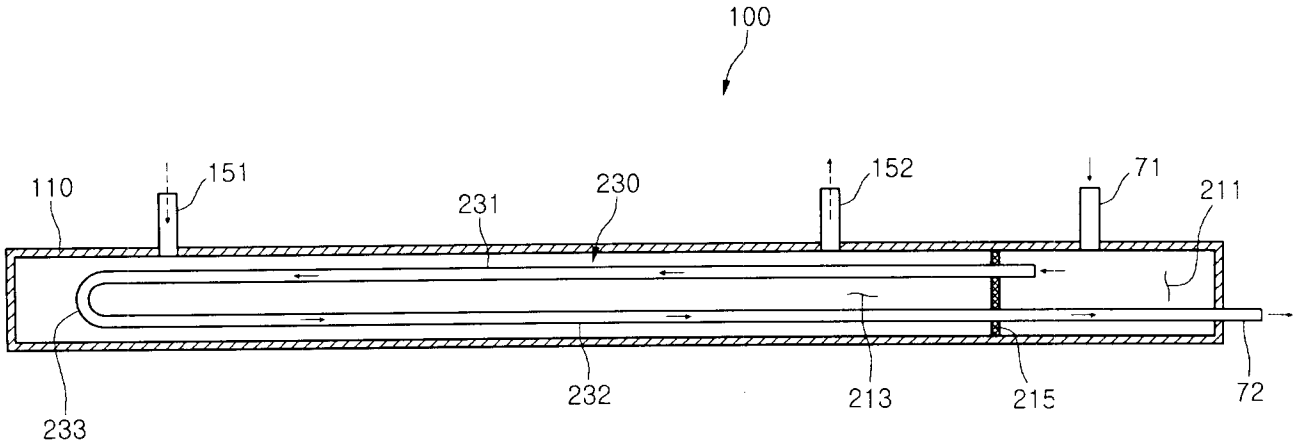
FIG. 6 is a cross-sectional view of a supercooler according to a second embodiment.

FIG. 6 is a cross-sectional view of a supercooler according to a second embodiment.

Referring to FIG. 6, a supercooling main body 110 according to the second embodiment includes an inner tube 230 in which a first refrigerant introduced through a main inflow part 71 flows.

In detail, the inner tube 230 includes a first tube 231 for guiding the first refrigerant so that the first refrigerant flows in one direction, a second tube 232 for guiding the first refrigerant so that the first refrigerant flows in the other direction, and a curved part 233 for switching a flow direction of the refrigerant. Here, the one direction and the other direction may be opposite to each other. Also, the first tube 231 and the second tube 232 may be called a "first passage" and a "second passage", respectively.

The supercooling main body 110 includes a storage part 211 in which the first refrigerant introduced through the main inflow part 71 is temporarily stored, a flow space part 213 partitioned from the storage part 211 and in which a second refrigerant introduced through an injection inflow part 151 flows, and a partition part 215 partitioning the storage part 211 from the flow space part 213.

The first tube 231 passes through the partition part 215 from the storage part 211 to extend in one direction (a left direction in FIG. 6).

The curved part 233 roundly extends from the first tube 231 to switch a flow direction of the first refrigerant flowing into the first tube 231. In FIG. 6, although the curved part 233 is a rounded shape, the present disclosure is not limited thereto. For example, the curved part 233 may be bent at a predetermined angle.

The second tube 232 extends from the curved part 233 in the other direction (i.e., a right direction in FIG. 6) to pass through the partition part 215, thereby being coupled to a main discharge part 72. The first refrigerant flowing into the second tube 232 is discharged from the supercooling main body 110 through the main discharge part 72.

The second refrigerant introduced through an injection inflow part 151 is heat-exchanged with the first refrigerant flowing into the first and second tubes 231 and 232 while the second refrigerant is discharged through the injection discharge part 152 via the flow space part 213. The flow space part 213 may be called a "third passage".

Thus, the first refrigerant may be primarily heat-exchanged with the second refrigerant of the flow space part 213 while flowing along the first tube 231 and be secondarily heat-exchanged with the second refrigerant while flowing along the second tube 232. Thus, the first refrigerant may be sufficiently supercooled.

In view of different flow directions of the refrigerant, a passage of the refrigerant flowing into the first tube 231 may be called a "first passage", and a passage of the refrigerant flowing into the second tube 232 may be called a "second passage".

Figure 7:
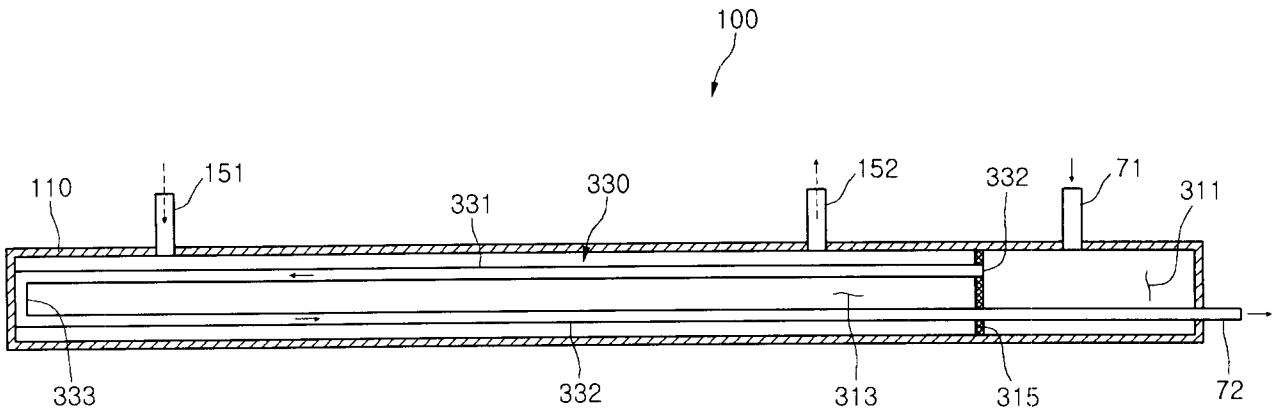
FIG. 7 is a cross-sectional view of a supercooler according to a third embodiment.

FIG. 7 is a cross-sectional view of a supercooler according to a third embodiment.

Referring to FIG. 7, a supercooling main body 110 according to the third embodiment includes a flow channel 330 providing a space in which a first refrigerant introduced through a main inflow part 71 flows.

In detail, the flow channel 330 includes a first channel 331 for guiding the first refrigerant so that the first refrigerant flows in one direction, a second channel 332 for guiding the first refrigerant so that the first refrigerant flows in the other direction, and a direction switch channel 333 for switching a flow direction of the refrigerant. Here, the one direction and the other direction may be opposite to each other.

Also, the direction switching channel 333 may be coupled to an inner surface of the supercooling main body 110.

The supercooling main body 110 includes a storage part 311 in which the first refrigerant introduced through the main inflow part 71 is temporarily stored, a flow space part 313 partitioned from the storage part 311 and in which a second refrigerant introduced through an injection inflow part 151 flows, and a partition part 315 partitioning the storage part 311 from the flow space part 313.

An inflow hole 332 communicating with the first channel 331 is defined in the partition part 315. The first channel 331 extends from the inflow hole 332 in one direction (a left direction in FIG. 7) and is coupled to an inner surface of the supercooling main body 110.

The direction switch channel 333 extends downward from an end of the first channel 331. The second channel 332 extends from an end of the direction switch channel 333 in the other direction (a right direction in FIG. 7) to pass through the partition part 315, thereby being coupled to a main discharge part 72. The first refrigerant flowing into the second channel 332 is discharged from the supercooling main body 110 through the main discharge part 72.

The second refrigerant introduced through the injection inflow part 151 is heat-exchanged with the first refrigerant flowing into the first and second channels 331 and 332 while the second refrigerant is discharged through the injection discharge part 152 via the flow space part 313.

Thus, the first refrigerant may be primarily heat-exchanged with the second refrigerant of the flow space part 313 while flowing along the first channel 331 and be secondarily heat-exchanged with the second refrigerant while flowing along the second channel 332. Thus, the first refrigerant may be sufficiently supercooled.

In view of different flow directions of the refrigerant, a passage of the refrigerant flowing into the first channel 331 may be called a "first passage", a passage of the refrigerant flowing into the second channel 332 may be called a "second passage", and a passage of the refrigerant flowing into the flow space part 313 may be called a "a third passage".

According to the embodiments, the plurality of tubes may be provided in the supercooling device, and the first refrigerant flowing into the plurality of tubes may be heat-exchanged with the second refrigerant flowing outside the tubes to increase the heat exchange area. Also, since the heat exchange area is increased, the supercooling efficiency may be improved, and sufficient supercooling may be secured to improve the operation efficiency of the refrigerant cycle.

Also, since the first refrigerant flows in one direction and the other direction opposite to the one direction, the first refrigerant may be heat-exchanged at least two times to improve the heat exchange efficiency.

Also, since the second refrigerant passing through the supercooling device is introduced (injected) into the compressor, an amount of refrigerant circulating into the compressor may be increased. Thus, the heating capacity may be improved.

Also, since the heat exchange effect is realized two or more times in one supercooling device due to the sample structure of the supercooling device, the device may have a compact structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising a compressor, a condenser, an expansion device, an evaporator, and a supercooling device configured to supercool a refrigerant passing through the condenser, wherein the supercooling device comprises:

a supercooling main body in which the refrigerant passing through the condenser and a refrigerant to be injected into the compressor are introduced;

a first passage disposed within the supercooling main body so that the refrigerant passing through the condenser flows in one direction;

a second passage disposed on a side of the first passage so that the refrigerant passing through the condenser flows in the other direction; and a third passage in which the refrigerant to be injected into the compressor flows, the third passage being heat-exchanged with at least one of the first and second passages, and wherein the first passage is provided in plurality and the second passage is a passage in which the plurality of first passages are combined.

2. The air conditioner according to claim 1, wherein a refrigerant flow direction in the first passage is opposite to that in the second passage.

3. The air conditioner according to claim 1, wherein the second passage is disposed between the plurality of first passages.

4. The air conditioner according to claim 1, wherein the second passage has a flow sectional area greater than that of each of the first passages.

5. The air conditioner according to claim 1, wherein the supercooling main body further comprises:

a first inflow part in which the refrigerant passing through the condenser is introduced; and a branch part by which the refrigerant introduced through the first inflow part is branched into the plurality of first passages.

6. The air conditioner according to claim 5, wherein the supercooling main body further comprises:

a flow space part provided in a side of the branch part to define the third passage; and a first partition part partitioning the branch part from the flow space part.

7. The air conditioner according to claim 6, wherein the supercooling main body further comprises:

a combining part defining a space in which the refrigerants discharged from the plurality of first passages are mixed with each other; and a second partition part partitioning the combining part from the flow space part.

8. The air conditioner according to claim 6, wherein the supercooling main body further comprises a first discharge part coupled to the second passage to discharge the refrigerant passing through the condenser after the refrigerant is heat exchanged with the refrigerant of the third passage.

9. The air conditioner according to claim 8, wherein the supercooling main body further comprises:

a second inflow part in which at least one portion of the refrigerant passing through the condenser is branched to flow; and a second discharge part through which the refrigerant introduced through the second inflow part is discharged via the third passage.

10. The air conditioner according to claim 1, wherein the supercooling main body further comprises a curved part for switching a refrigerant flow direction in the first passage toward the second passage.

11. The air conditioner according to claim 10, wherein the supercooling main body comprises:

a first inflow part through which the refrigerant passing through the condenser is introduced into the supercooling main body;

a second inflow part through which the refrigerant to be injected into the compressor is introduced into the supercooling main body; and a partition part partitioning a flow space for the refrigerant introduced through the first inflow part from a flow space for the refrigerant introduced through the second inflow part.

12. The air conditioner according to claim 1, wherein the supercooling main body further comprises a direction switch channel connecting the first passage to the second passage and coupled to an inner surface of the supercooling main body.

13. The air conditioner according to claim 1, wherein at least one of the first and second passages is a capillary tube.

14. An air conditioner comprising:

a compressor compressing a refrigerant;

a condenser condensing the refrigerant passing through the compressor; and a supercooler disposed on a side of an outlet of the condenser, wherein the supercooler comprises:

a first inflow part through which the refrigerant passing through the condenser is introduced;

a second inflow part through which a refrigerant to be injected into the compressor is introduced;

a first passage disposed within the supercooler, the first passage being configured to primarily heat-exchange the refrigerant introduced through the first inflow part with the refrigerant introduced through the second inflow part;

a second passage communicating with the first passage, the second passage being configured to secondarily heat-exchange the refrigerant passing through the first passage with the refrigerant introduced through the second inflow part; and a flow space part in which the refrigerant introduced through the second inflow part flows, the flow space part being configured to cool the refrigerants of the first and second passages, wherein the first passage comprises a plurality of branch tubes in which the refrigerant introduced through the first inflow part is branched to flow and the second passage comprises a combining tube in which the refrigerants of the plurality of branch tubes are mixed to flow.

15. The air conditioner according to claim 14, wherein the flow space part is defined outside of the first and second passages in an inner space of the supercooler.

16. The air conditioner according to claim 14, wherein a refrigerant flow direction of the first passage is opposite to that in the second passage.

17. The air conditioner according to claim 14, wherein the refrigerant introduced through the second inflow part is heat-exchanged with the refrigerants flowing into the first and second passages.

18. The air conditioner according to claim 14, wherein the supercooler comprises a partition part partitioning the flow space part from the first and second passages to prevent the flow space part from communicating with the first and second passages, wherein the partition part comprises:

a branch part for guiding distribution of the refrigerant introduced through the first inflow part;

a first partition part partitioning the flow space part; and a second partition part partitioning a flow space for the refrigerant passing through the first passage from the flow space part.

* * * * *